US005334575A

United States Patent [19]

Noonan et al.

[11] Patent Number: 5,334,575

[45] Date of Patent: Aug. 2, 1994

[54] DYE-CONTAINING BEADS FOR LASER-INDUCED THERMAL DYE TRANSFER

[75] Inventors: John M. Noonan, Rochester; Mitchell S. Burberry, Webster, both of N.Y.

[73] Assignee: Eastman Kodak Company, Rochester, N.Y.

[21] Appl. No.: 992,350

[22] Filed: Dec. 17, 1992

[51] Int. Cl.[5] ..... B41M 5/035; B41M 5/38

[52] U.S. Cl. ..... 503/227; 428/195; 428/327; 428/478.2; 428/508; 428/509; 428/510; 428/913; 428/914; 430/200; 430/201; 430/945

[58] Field of Search ..... 8/471; 428/195, 323, 428/327, 478.2, 508-510, 913, 914; 430/200, 201, 945; 503/227

[56] References Cited

U.S. PATENT DOCUMENTS 4,833,060 5/1989 Nair et al. ..... 430/137

FOREIGN PATENT DOCUMENTS

88/07450 10/1988 World Int. Prop. O. ..... 430/138

*Primary Examiner*—B. Hamilton Hess
*Attorney, Agent, or Firm*—Harold E. Cole

[57] ABSTRACT

This invention relates to a monocolor dye donor element for laser-induced thermal dye transfer comprising a support having thereon a dye layer comprising solid, homogeneous beads which contain an image dye, a binder and a laser light-absorbing material, said beads being dispersed in a vehicle.

18 Claims, No Drawings

DYE-CONTAINING BEADS FOR LASER-INDUCED THERMAL DYE TRANSFER

This invention relates to the use of certain dye-containing beads in the donor element of a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

A laser imaging system typically involves a donor element comprising a dye layer containing an infrared-absorbing material, such as an infrared-absorbing dye, and one or more image dyes in a binder.

PCT publication WO 88/07450 discloses an inking ribbon for laser thermal dye transfer comprising a support coated with microcapsules containing printing inks and laser light-absorbers. There are a number of problems associated with the use of microcapsules in dye-donors. Microcapsules have cell walls that encapsulate ink and associated volatile ink solvents which are typically low-boiling oils or hydrocarbons that can be partially vaporized during printing and evaporate readily on the receiver as the ink dries. The use of volatile solvents can cause health and environmental concerns. In addition, solvent in the microcapsules can dry out over time before printing and therefore lead to changes in sensitivity (i.e., poor dye-donor shelf life). Further, since microcapsules are pressure-sensitive, if they are crushed, ink and solvent can leak out. Still further, microcapsule ceil walls burst when printed, releasing ink in an all-or-nothing manner, making them poorly suited for continuous tone applications.

In U.S. Pat. No. 4,833,060, a method is disclosed for making polymeric particles by mixing an oil phase which contains organic components, under high shear conditions, in water with stabilizer and promoter to form an emulsion having a well-defined droplet size distribution. The solvent in the oil phase is then distilled off leaving the solid particles dispersed in water. There is no disclosure in this patent, however, of using this technique to make a dye-donor element for a laser-induced thermal dye transfer system.

It is an object of this invention to provide dye-donor element or a laser-induced thermal dye transfer system which avoids the problems noted above with using microcapsules.

These and other objects are achieved in accordance with this invention which relates to a monocolor dye donor element for laser-induced thermal dye transfer comprising a support having thereon a dye layer comprising solid, homogeneous beads which contain an image dye, a binder and a laser light-absorbing material, said beads being dispersed in a vehicle.

The beads which contain the image dye, binder and laser light-absorbing material can be made by the process disclosed in U.S. Pat. No. 4,833,060 discussed above, the disclosure of which is hereby incorporated by reference. The beads are described as being obtained by a technique called "evaporated limited coalescence".

The binders which may be employed in the solid, homogeneous beads of the invention which are mixed with the image dye and laser light-absorbing material include materials such as cellulose acetate propionate, cellulose acetate butyrate, polyvinyl butyral, nitrocellulose, poly(styrene-co-butyl acrylate), polycarbonates such as Bisphenol A polycarbonate, poly(styrene-co-vinylphenol) and polyesters. In a preferred embodiment of the invention, the binder in the beads is cellulose acetate propionate or nitrocellulose. While any amount of binder may be employed in the beads which is effective for the intended purpose, good results have been obtained using amounts of up to about 50% by weight based on the total weight of the bead.

The vehicle in which the beads are dispersed to form the dye layer of the invention includes water-compatible materials such as poly(vinyl alcohol), pullulan, polyvinylpyrrolidone, gelatin, xanthan gum, latex polymers and acrylic polymers. In a preferred embodiment of the invention, the vehicle used to disperse the beads is gelatin.

The beads are approximately 0.1 to about 20 μm in size, preferably about 1 μm. The beads can be employed at any concentration effective for the intended purpose. In general, the beads can be employed in a concentration of about 40 to about 90% by weight, based on the total coating weight of the bead-vehicle mixture.

While the dye-donors of the invention have only a single color, use of three different colors, i.e., cyan, magenta and yellow, will provide a multicolor image, either in a transparency or a reflection print.

Spacer beads are normally employed in a laser-induced thermal dye transfer system to prevent sticking of the dye-donor to the receiver. By use of this invention however, spacer beads are not needed, which is an added benefit.

To obtain tile laser-induced thermal dye transfer image employed in the invention, a diode laser is preferably employed since it offsets substantial advantages in terms of its small size, low cost, stability, reliability, ruggedness, and ease of modulation. In practice, before any laser can be used to heat a dye-donor element, the element must contain a laser light-absorbing material, such as carbon black or cyanine infrared-absorbing dyes as described in U.S. Pat. No. 4,973,572, or other materials as described in the following U.S. Pat. Nos. 4,948,777, 4,950,640, 4,950,639, 4,948,776, 4,948,778, 4,942,141, 4,952,552, 5,036,040, and 4,912,083, the disclosures of which are hereby incorporated by reference. The laser light-absorbing material can be employed at any concentration effective for the intended purpose. In general, good results have been obtained at a concentration of about 6 to about 25% by weight, based on the total weight of the bead. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. As noted above, the laser light-absorbing material is contained in the beads coated on the donor support.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses a laser as described above to form an image on a thermal print medium is described and claimed in copending U.S. application Ser. No. 451,656 of Baek and DeBoer, filed Dec. 18, 1989, the disclosure of which is hereby incorporated by reference.

Any image dye can be used in the beads of the dye-donor employed in the invention provided it is transferable to the dye-receiving layer by the action of the laser. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

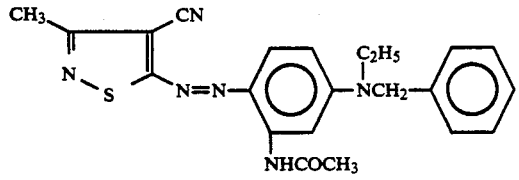
(magenta)

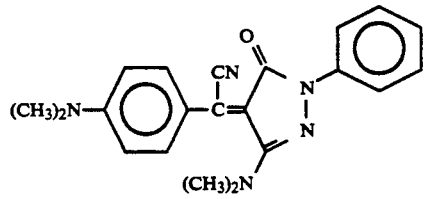
(magenta)

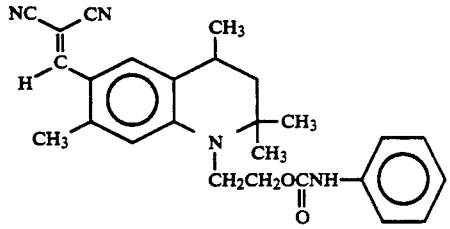
(yellow)

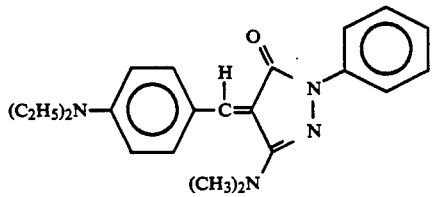
(yellow)

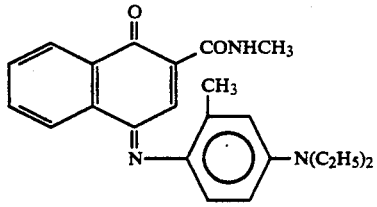
(cyan)

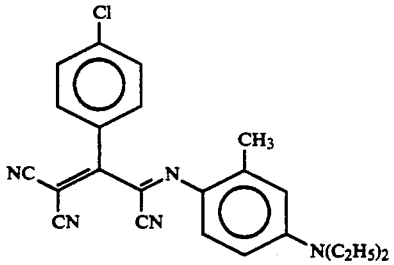
(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The image dye may be employed in the bead in any amount effective for the intended purpose. In general, good results have been obtained at a concentration of about 40 to about 90% by weight, based on the total weight of the bead.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. It may also be coated with a subbing layer, if desired, such as those materials described in U.S. Pat. Nos. 4,695,288 or 4,737,486.

The dye-receiving element that is used with the dye-donor element employed in the invention usually comprises a support having thereon a dye image-receiving layer or may comprise a support made out of dye image-receiving material itself. The support may be glass or a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as DuPont Tyvek ®.

The dye image-receiving layer may comprise, for example, a polycarbonate, a polyester, cellulose esters, Poly(styrene-co-acrylonitrile), polycapro-lactone or mixtures thereof. The dye image-receiving layer may be present in any amount which is effective for the intended purpose. In general, good results have been obtained at a concentration of from about 1 to about 5 $g/m^2$.

A process of forming a laser-induced thermal dye transfer image according to the invention comprises:

a) contacting at least one dye-donor element as described above, with a dye-receiving element comprising a support having thereon a polymeric dye image-receiving layer;

b) imagewise-heating the dye-donor element by means of a laser; and c) transferring a dye image to the dye-receiving element to form the laser-induced thermal dye transfer image.

To get a multicolor image, the above process is repeated three times, using cyan, magenta and yellow dye-donors.

The following examples are provided to illustrate the invention.

Preparation of Bead Dispersions

A combination of a polymeric binder as described below, image dye, and laser light-absorbing dye were dissolved in dichloromethane (or methylisopropyl ketone where indicated). A mixture of 30 ml of Ludox ® $SiO_2$ (DuPont) and 3.3 ml of AMAE (a copolymer of methylaminoethanol and adipic acid) (Eastman Kodak Co.) was added to 1000 ml of phthalic acid buffer (pH 4). The organic and aqueous phases were mixed together under high shear conditions using a microfluidizer. The organic solvent was then distilled from the resulting emulsion by bubbling dry $N_2$ through the emulsion or by distillation using a rotavaporizer. This procedure resulted in an aqueous dispersion of solid beads in a water phase which was coarse-filtered followed by diafiltration, and the particles were isolated by centrifugation. The isolated wet particles were put into distilled water am a concentration of approximately 15 wt. %.

COATING PREPARATIONS

Examples 1a, 1b, and 1c

A 10.8 wt % aqueous dispersion was prepared from 11.75 g cellulose acetate propionate (CAP) binder (2.5% acetyl, 45% propionyl) and 11.74 g of the first magenta dye illustrated above, 11.74 g of the second magenta dye illustrated above and 4.8 g IR-absorbing dye illustrated below. Three coatings differing in their dispersion vehicles were prepared by adding to 2 g of this dispersion 0.11 g of hydrolyzed poly(vinyl alcohol) (PVA) (Aldrich Chemical Co.) pullulan (TCI America), or polyvinylpyrrolidone ( PVP) (Aldrich Chemical Co.), respectively, using the bead dispersion technique described above. The resulting three formulations were hand-coated onto a gelatin-subbed, 100 μm poly (ethylene terephthalate) support at 110° C. using a 50 μm coating knife.

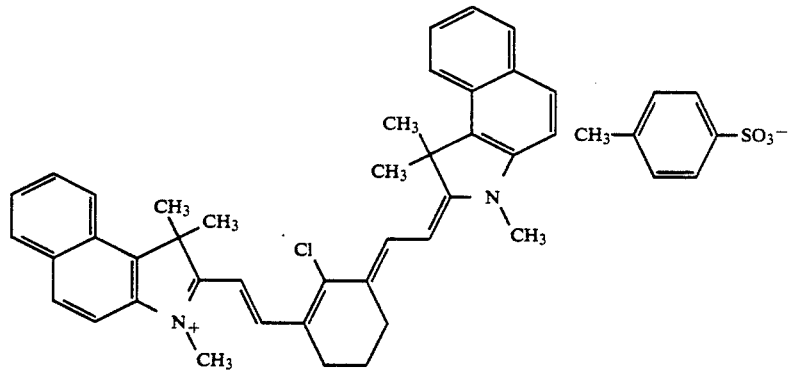

IR-Absorbing Dye IR-1

Example 2

A magenta coating was made by adding 0.67 g of gelatin (12.5% solids) and 2.44 g of a bead dispersion (6.83% solids) prepared as described above from 13.0 g CAP, 13.0 g of each of the magenta dyes illustrated above and 6.0 g of IR-1 illustrated above to 6.89 g of distilled water. This bead melt was then hand-coated onto a 100 μm poly(ethylene terephthalate) support.

Example 3

A yellow coating was made from a yellow bead dispersion (14.42% solids) prepared as described above from 13.0 g CAP, 20.8 g of the first yellow dye illustrated above, 5.2 g of the second yellow dye illustrated above, and 6.0 g of IR-1 illustrated above by diluting 1.566 g of this dispersion and 0.67 g gelatin and 0.23 g of a 10% solution of Dowfax® 2A1 surfactant (Dow Chemical Co.) with 7.944 g of distilled water. This bead melt was then coated onto a 100 μm poly(ethylene terephthalate) support.

Example 4

A cyan bead dispersion was prepared as described above from 13.0 g CAP, 13.0 g of each of the cyan dyes illustrated above, and 6.0 g of IR-1 illustrated above. This bead dispersion (1.33 g, 12.57% solids), 0.67 g gelatin (12.5%), and 0.23 g of a 10% solution of Dowfax® 2A1 surfactant were diluted with 7.77 g of distilled water. The bead melt was then coated onto a 100 μm poly(ethylene terephthalate) support.

Example 5

A magenta bead dispersion was prepared as described above from 13.0 g CAP, 13.0 g of each of the magenta dyes illustrated above, and 6.0 g of IR-1 illustrated above. This bead dispersion (1.09 g, 15.35% solids), 0.67 g gelatin (12.5%), and 0.23 g of a 10% solution of Dowfax® 2A1 surfactant were diluted with 8.01 g of distilled water. The bead melt was then coated onto a 100 μm poly(ethylene terephthalate) support.

Example 6

To 1.09 g of the magenta dispersion of Example 5 was added 0.67 g gelatin (12.5%), 0.23 g of a 10% solution of Dowfax® 2A1 surfactant, and 8.01 g of distilled water. The bead melt was then coated onto a subbed 100 μm poly(ethylene terephthalate) support.

Example 7

To 1.56 g of the yellow dispersion of Example 3 was added 0.67 g gelatin (12.5%), 0.23 g of a 10% solution of Dowfax® 2A1 surfactant, and 7.944 g of distilled water. This bead melt was then coated onto a subbed 100 μm poly(ethylene terephthalate) support.

PRINT ENGINES

Experiments were conducted on two breadboard laser printers. One used a spinning drum to scan a beam from a laser-diode/fiberoptic source across the media assembly. A second print engine utilized a galvanic mirror to scan a Gaussian laser beam across a dye-donor/dye-receiver assembly, held on a flat bed with vacuum applied between the dye-donor and dye-receiver sheets.

RECEIVER FOR DRUM PRINT ENGINE

An intermediate dye-receiving element was prepared by coating on an unsubbed 100 μm thick poly(ethylene terephthalate) support a layer of crosslinked poly(styrene-co-divinylbenzene) beads (14 micron average diameter) (0.11 g/m$^2$), triethanolamine (0.09 g/m$^2$) and DC-510® Silicone Fluid (Dow Corning Company) (0.01 g/m$^2$) in a Butvar® 76 binder, a poly(vinyl alcohol-co-butyral), (Monsanto Company) (4.0 g/m$^2$) from 1,1,2-trichloroethane or dichloromethane.

DRUM PRINT ENGINE OPERATION

The assemblage of dye-donor and dye-receiver was scanned by a focused laser beam on a rotating drum, 31.2 cm in circumference, turning at either 350, 450, or 550 rev/min, corresponding to line writing speeds of 173, 222, or 271 cm/sec, respectively. A Spectra Diode Labs Laser Model SDL-2430-H2 was used and was rated at 250 mW, at 816 nm. The measured power and spot size at the donor surface was 115 mW and 33 μm (1/e$^2$), respectively. Power was varied from maximum to minimum values in 11 step patches of fixed power increments. The laser spot was stepped with a 14 μm center-to-center line pitch corresponding to 714 lines/cm or 1800 lines/in.

After the laser had scanned approximately 12 mm, the laser exposing device was stopped and the intermediate receiver was separated from the dye donor. The intermediate receiver containing the stepped dye image was laminated to Ad-Proof Paper® (Appleton Papers, Inc.) 60 pound stock paper by passage through a pair of rubber rollers heated to 120° C. The polyethylene terephthalate support was then peeled away leaving the dye image and polyvinyl alcohol-co-butyral firmly adhered to the paper.

FLAT BED PRINT ENGINE OPERATION

A Hitachi model HC8351E diode laser (rated at 50 mW, at 830 nm) was collimated and focussed to an elliptical spot on the dye-donor sheet approximately 13 μm (1/e$^2$) in the page direction and 14 μm (1/e$^2$) in the fast scan direction. The galvanometer scan rate was typically 70 cm/sec and the measured maximum power at the dye-donor was 37 mW, corresponding to an exposure of approximately 0.5 J/cm$^2$. Power was varied from this maximum to a minimum value in 16 step patches of fixed power increments. Spacing between line scans in the page direction was typically 10 μm center-to-center corresponding to 1000 lines/cm or 2500 lines/in. Prints were made to either a resin-coated paper support or a transparent receiver and fused in acetone vapors at room temperature for 7 minutes. The transparent receiver was prepared from flat samples (1.5 mm thick) of Ektar® DA003 (Eastman Kodak), a mixture of bisphenol A polycarbonate and poly (1,4-cyclohexylene dimethylene terephthalate) (50:50 mole ratio).

SENSITOMETRY

Sensitometric data were obtained using a calibrated X-Rite 310 Photographic Densitometer (X-Rite Co., Grandville, MI) from printed step targets. Status A red, green and blue transmission densities were read from transparent receivers while status A red, green and blue reflection densities were read from paper receivers and indirect receivers laminated to paper.

RESULTS

Dye-donor Examples 1a, 1b, and 1c were printed using the drum printer in the usual "forward" and "reverse" exposure modes. These coatings were prepared with relatively heavy coverages. In the "forward" mode, light is incident on the support side of the donor and is absorbed strongly at the interface between coating and support. Under these exposure conditions thick coatings do not image well. However, in the "reverse" mode, where light is incident through a transparent receiver on the free side of the donor coating, high density images were obtained as shown below:

TABLE I

| COATING | VEHICLE | STATUS A GREEN DENSITY |
|---|---|---|
| Example 1a | PVA | 2.04 |
| Example 1b | Pullulan | 2.37 |
| Example 1c | PVP | 2.40 |

The results in Table I indicate that good print densities are obtained with any of several water-compatible vehicles used to adhere the beads to the support.

All subsequent examples were coatings with lower solid laydown and were printed in the "forward" exposure mode. Results obtained from the bead dye-donors, using the drum print engine, are summarized in Table II below. The first column indicates the laser power, at 816 nm, incident on the dye-donor. Columns two through four list the Status A Green Reflection Densities obtained from the magenta dye transfer onto a receiver that was subsequently laminated to paper. The last two columns list yellow and cyan dye transfer densities, respectively. The corresponding scan velocities for each print are also indicated.

TABLE II

| | Magenta EXAMPLE 2 Status A Green Density | | | Yellow EXAMPLE 3 | Cyan EXAMPLE 4 |
|---|---|---|---|---|---|
| Laser Power (mW) | 550 rev/min | 450 rev/min | 350 rev/min | Status A Blue Density 350 rev/min | Status A Red Density 350 rev/min |
| 115 | 1.94 | 2.00 | 2.24 | 2.35 | 1.86 |
| 105 | 2.00 | 2.40 | 2.46 | 2.35 | 1.94 |
| 94 | 1.42 | 2.44 | 2.72 | 2.19 | 1.81 |
| 84 | 1.70 | 2.08 | 2.48 | 2.25 | 1.55 |
| 73 | 1.48 | 2.25 | 2.24 | 2.31 | 1.40 |
| 63 | 1.16 | 2.12 | 2.21 | 2.25 | 1.14 |
| 52 | 1.12 | 1.84 | 2.33 | 2.09 | 0.88 |
| 42 | 0.95 | 1.56 | 2.23 | 2.13 | 0.56 |
| 31 | 0.71 | 1.17 | 2.05 | 1.59 | 0.32 |
| 21 | 0.42 | 1.00 | 1.80 | 1.14 | 0.21 |
| 11 | 0.26 | 0.61 | 0.95 | 0.81 | 0.12 |

The data in Table II indicate that reflection densities on the order of 2 o.d. are achieved with 115 mW, at scan speeds up to 222 cm/s and a 14 μm line spacing. Densities exceeding 2.2 o.d. were obtained at writing speeds of 173 cm/s. These exposures correspond to approximately 0.4 J/cm$^2$ and 0.5 J/cm$^2$ of continuously printed surface area, respectively.

The data in Table II also show that dye density increases in approximate proportion with laser power over a useful power range and at fast scan rates. Thus, the bead dye-donors of the invention are intrinsically capable of printing continuous tone images.

Results obtained using the flat bed print engine are summarized in Table III. The first column lists the incident 830 nm laserpower at the dye-donor surface. Column two records the transmission density obtained from a magenta-dye transfer onto a transparent receiver. The last three columns list the cyan, magenta and yellow dye density printed directly to resin-coated paper support. Prints were fused for seven minutes in acetone-vapor-saturated air, at room temperature.

TABLE III

| Power (mW) | Magenta EXAMPLE 5 Transmission Density | Cyan EXAMPLE 4 Reflection Density | Magenta EXAMPLE 6 Reflection Density | Yellow EXAMPLE 7 Reflection Density |
|---|---|---|---|---|
| 37.0 | 1.37 | 1.61 | 1.77 | 1.90 |
| 34.7 | 1.39 | 1.66 | 1.73 | 1.83 |
| 32.4 | 1.33 | 1.69 | 1.77 | 1.85 |
| 30.0 | 1.24 | 1.68 | 1.79 | 1.80 |
| 27.7 | 1.15 | 1.64 | 1.76 | 1.66 |
| 25.4 | 0.96 | 1.61 | 1.80 | 1.77 |
| 23.1 | 0.80 | 1.52 | 1.80 | 1.66 |
| 20.7 | 0.64 | 1.21 | 1.72 | 1.55 |
| 18.4 | 0.43 | 0.91 | 1.37 | 1.13 |
| 16.1 | 0.24 | 0.55 | 0.94 | 0.83 |
| 13.8 | 0.08 | 0.08 | 0.38 | 0.38 |
| 11.5 | 0.00 | 0.00 | 0.05 | 0.04 |
| 9.1 | 0.00 | 0.00 | 0.00 | 0.00 |
| 6.8 | 0.00 | 0.00 | 0.00 | 0.00 |
| 4.5 | 0.00 | 0.00 | 0.00 | 0.00 |
| 2.2 | 0.00 | 0.00 | 0.00 | 0.00 |

The results in Table III show that densities as high as 1.4 in transmission and 1.9 in reflection were achieved with as little as 37 mW, 10 μm line spacing and a scan velocity of as much as 70 cm/s. This exposure corresponds to approximately 0.5 J/cm$^2$and is considerably less than that reported for microcapsule donors (6 J/cm$^2$ according to B. Fischer, B. Mader, H. Meixner, P. Kleinschmidt, J. Image Tech., page 291, 1988). Thus the bead dye-donors of the invention are about an order of magnitude more sensitive (i.e., faster) than microcapsule dye-donors.

The data in Table III also show that dye density increases in approximate proportion with laser power over a useful power range and at fast scan rates. Thus, the bead dye-donors of the invention are intrinsically capable of printing continuous tone images.

Example 8

Use of Nitrocellulose Binder

A cyan bead dispersion similar to Example 4 was prepared except that the binder was nitrocellulose (NC) (RS ½ sec. Hercules Co.) instead of CAP, employed at equal weight, and the organic solvent was methylisopropyl ketone. This bead dispersion (3.18 g, 14.7% solids), 0.93 g gelatin (12.5%), 2.0 g of a 1% solution of Keltrol T® xanthan gum (Merck Co. ) and 0.92 g of a 10% solution of Dowfax® 2A1 surfactant were diluted with 13.0 g of distilled water. The bead melt was then coated onto a 100 μm poly(ethylene terephthalate) support.

Example 9

This Example was similar To Example 8 except that the binder was CAP.

Example 10

This Example was similar to Example 8 except that no gelatin was added. In this case, the Keltrol T® is the coating vehicle.

Example 11

This Example was similar to Example 9 except that no gelatin was added. In this case, the Keltrol T® is the coating vehicle.

The results obtained for Status A red print density from cyan bead dye-donors containing nitrocellulose and CAP are summarized in Table IV below. Two different coating vehicles formulations are also compared. The data was generated using the drum print engine at 550 rev/min.

TABLE IV

| Example | Binder | Vehicle | D-Max |
|---|---|---|---|
| 8 | NC | Gelatin + Keltrol T ® | 2.3 |
| 9 | CAP | Gelatin + Keltrol T ® | 2.2 |
| 10 | NC | Keltrol T ® | 2.3 |
| 11 | CAP | Keltrol T ® | 2.0 |

The above data show an advantage for bead dye-donors containing NC as the binder instead of CAP. The D-Max is about 5% higher for a NC binder when gelatin and Keltrol T ® are used as the coating vehicle, and about 13% higher when Keltrol T ® alone is the coating vehicle. This advantage may be taken as improved print density or faster printing times at equal print density.

The invention has been described in detail with particular reference to preferred embodiments thereof, but it will be understood that variations and modifications can be effected within the spirit and scope of the invention.

What is claimed is:

1. A monocolor dye donor element for laser-induced thermal dye transfer comprising a support having thereon a dye layer comprising solid, homogeneous beads which contain an image dye, a binder and a laser light-absorbing material, said beads being dispersed in a vehicle.

2. The element of claim 1 wherein said vehicle is gelatin.

3. The element of claim 1 wherein said binder is cellulose acetate propionate or nitrocellulose.

4. The element of claim 1 wherein said beads are approximately 0.1 to about 20 μm in size.

5. The element of claim 1 wherein said beads are employed at a concentration of about 40 to about 90% by weight, based on the total coating weight of the bead-vehicle mixture.

6. The element of claim 1 wherein said laser light-absorbing material is a dye.

7. A process of forming a laser-induced thermal dye transfer image comprising:

a) contacting at least one monocolor dye donor element comprising a support having thereon a dye layer comprising solid, homogeneous beads which contain an image dye, a binder and a laser light-absorbing material, said beads being dispersed in a vehicle, with a dye-receiving element comprising a support having thereon a polymeric dye image-receiving layer;

b) imagewise-heating said dye-donor element by means of a laser; and c) transferring a dye image to said dye-receiving element to form said laser-induced thermal dye transfer image.

8. The process of claim 7 wherein said vehicle is gelatin.

9. The process of claim 7 wherein said binder is cellulose acetate propionate or nitrocellulose.

10. The process of claim 7 wherein said beads are approximately 0.1 to about 20 μm in size.

11. The process of claim 7 wherein said beads are employed at a concentration of about 40 to about 90% by weight, based on the total coating weight of the bead-vehicle mixture.

12. The process of claim 7 wherein said laser light-absorbing material is a dye.

13. A thermal dye transfer assemblage comprising:

(a) a dye donor element comprising a support having thereon a dye layer comprising solid, homogeneous beads which contain an image dye, a binder and a laser light-absorbing material, said beads being dispersed in a vehicle, and (b) a dye-receiving element comprising a support having thereon a dye image-receiving layer, said dye-receiving element being in superposed relationship with said dye-donor element so that said dye layer is in contact with said dye image-receiving layer.

14. The assemblage of claim 13 wherein said vehicle is gelatin.

15. The assemblage of claim 13 wherein said binder is cellulose acetate propionate or nitrocellulose.

16. The assemblage of claim 13 wherein said beads are approximately 0.1 to about 20 μm in size.

17. The assemblage of claim 13 wherein said beads are employed at a concentration of about 40 to about 90% by weight, based on the total coating weight of the bead-vehicle mixture.

18. The assemblage of claim 13 wherein said laser light-absorbing material is a dye.

* * * * *